US005285356A

United States Patent [19]

Skene et al.

[11] Patent Number: 5,285,356

[45] Date of Patent: Feb. 8, 1994

[54] LIGHTING APPLIANCE, PARTICULARLY FOR ENVIRONMENTS WITHOUT NATURAL LIGHT

[75] Inventors: Douglas Skene, Ottawa, Canada; Piera Scuri, Milan; Daniele Bedini, Montelupo Fiorentino, both of Italy

[73] Assignee: iGuzzini Illuminazione S.r.l., Recanati, Italy

[21] Appl. No.: 980,340

[22] Filed: Nov. 23, 1992

[30] Foreign Application Priority Data

Nov. 29, 1991 [IT] Italy ..... MI91-A-003197

[51] Int. Cl.[5] ..... F21V 13/04

[52] U.S. Cl. ..... 362/1; 362/231; 362/307

[58] Field of Search ..... 362/1, 2, 231, 276, 362/805, 233, 307

[56] References Cited

U.S. PATENT DOCUMENTS

| | | | |
|---|---|---|---|
| 1,326,393 | 12/1919 | D'Humy | 362/2 |
| 1,784,171 | 12/1930 | Bertling | 362/2 |
| 2,725,461 | 11/1955 | Amour | 362/2 |
| 3,093,319 | 6/1963 | Gamain | 362/231 |
| 3,180,978 | 4/1965 | Mas . | |
| 3,517,180 | 6/1970 | Semotan | 362/1 |
| 3,536,905 | 10/1970 | Ruff et al. | 362/1 |
| 4,423,469 | 12/1983 | Zerlaut et al. | 362/1 |
| 4,933,813 | 6/1990 | Berger | 362/2 |
| 5,060,118 | 10/1991 | Penrod et al. | 362/1 |

FOREIGN PATENT DOCUMENTS

| | | |
|---|---|---|
| 3916997 | 12/1989 | Fed. Rep. of Germany . |
| 2151121 | 4/1973 | France . |
| WO8501566 | 4/1985 | PCT Int'l Appl. . |

*Primary Examiner*—Richard R. Cole

*Attorney, Agent, or Firm*—Hedman, Gibson & Costigan

[57] ABSTRACT

To allow environments to be lit with light having characteristics as close as possible to natural light, the appliance (1) comprises a frame (2) supporting pluralities of light sources (5, 6) the light from which is reflected to the outside of the appliance (1) by a reflecting screen (4) via a translucent screen (3). The light sources (5, 6) are of different color temperatures in terms of illumination and are electrically powerable separately via a central control unit (24) in a such a manner as to enable them to provide a luminous flux of variable intensity.

17 Claims, 6 Drawing Sheets

LIGHTING APPLIANCE, PARTICULARLY FOR ENVIRONMENTS WITHOUT NATURAL LIGHT

This invention relates to a lighting appliance, particularly for environments without natural light.

Environments are known to exist, even for residential and working use, which for various reasons are without natural light. Artificial light is therefore used to light such environments. Medical research has however shown that the more a subject remains within environments lit by only artificial light, the greater is the probability of his suffering disturbances, the most frequent of which is a loss of the sense of time, which our body spontaneously assumes by virtue of the time signals implicit in natural light.

Hence in the current state of the art the only remedy is to limit the time for which a subject remains in environments without natural light, particularly in the case of a subject particularly sensitive to such phenomena.

The object of the present invention is to obviate the aforesaid drawbacks.

This object is attained by a lighting appliance in accordance with the first claim.

By providing several light sources of different colour temperature and enabling them to be powered separately, the quality of the light emitted by the appliance can be influenced such that it resembles natural light as much as possible.

In addition the facility for varying the operating intensity of the individual light sources enables the light to be given the desired directionality through the translucent screen, in order to simulate the movement of the sun as the hour of the day varies. The lighting appliance is therefore able to operate in a manner similar to that of a traditional skylight when traversed by natural light, which as is well known varies during the day not only in terms of colour temperature and intensity but also in terms of direction. By preventing reflection of the single images of the light sources and favouring diffusion of the light rays emitted by said sources, the translucent screen contributes to creating the desired "skylight effect".

The desired effect can be optimized by providing a central unit for controlling the operation of the light sources moment by moment on the basis of the type of day which it is desired to simulate, by using a predetermined software program.

The invention is illustrated by way of non-limiting example in the figures of the accompanying drawings.

Corresponding elements are indicated therein by the same reference numerals plus the letter A.

Figure 1:
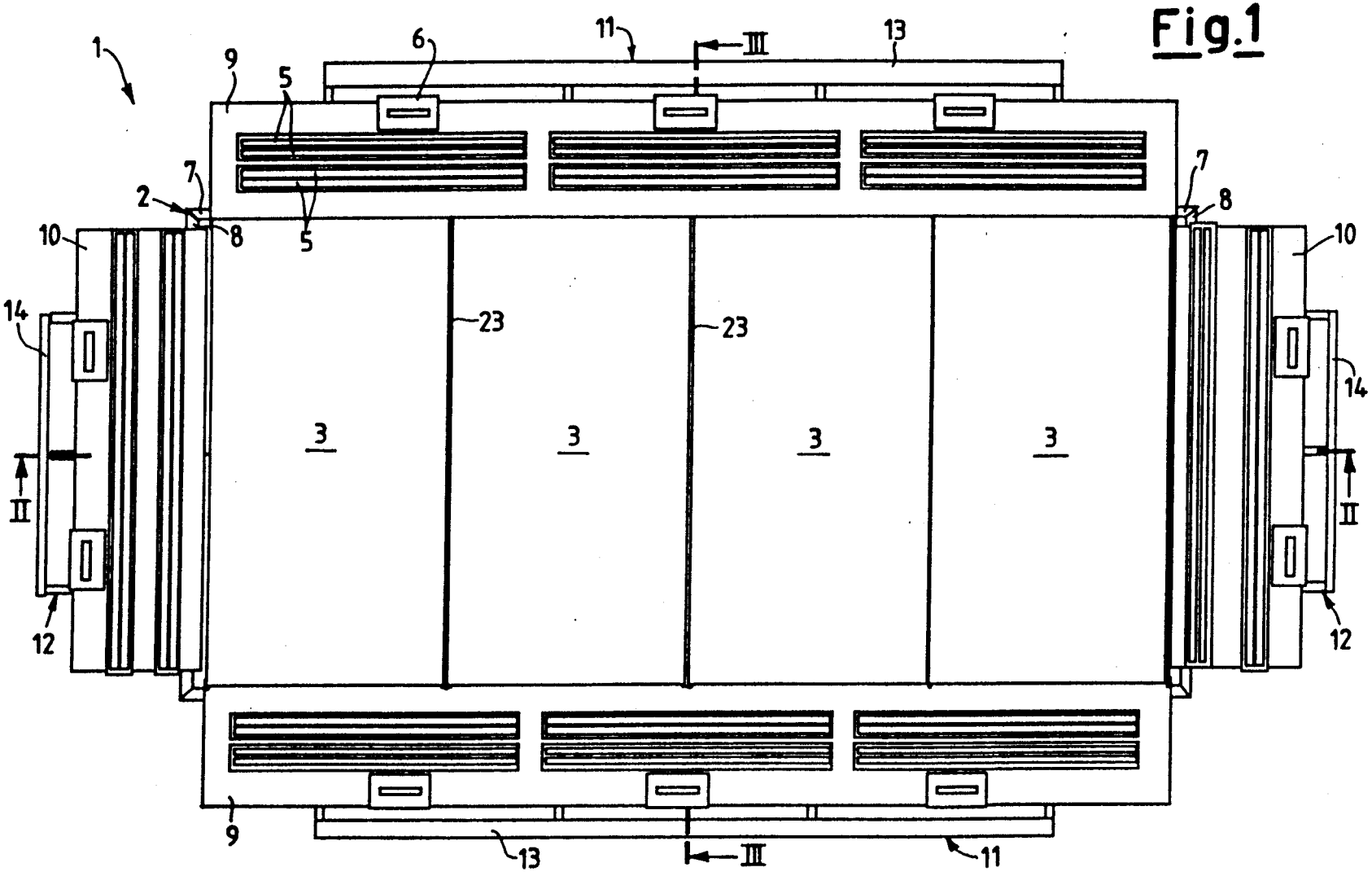
FIG. 1 is a plan view of a lighting appliance according to the invention with the reflecting screen removed in order to show the components.
Figure 2:
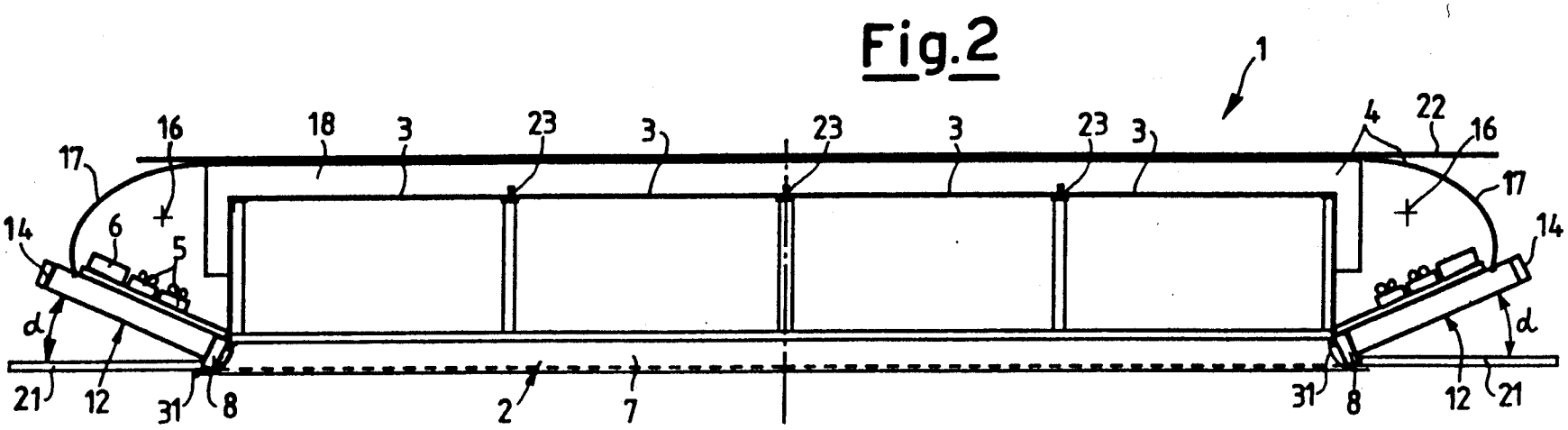
FIG. 2 is a section on the line II—II of FIG. 1 complete with the reflecting screen.
Figure 4:
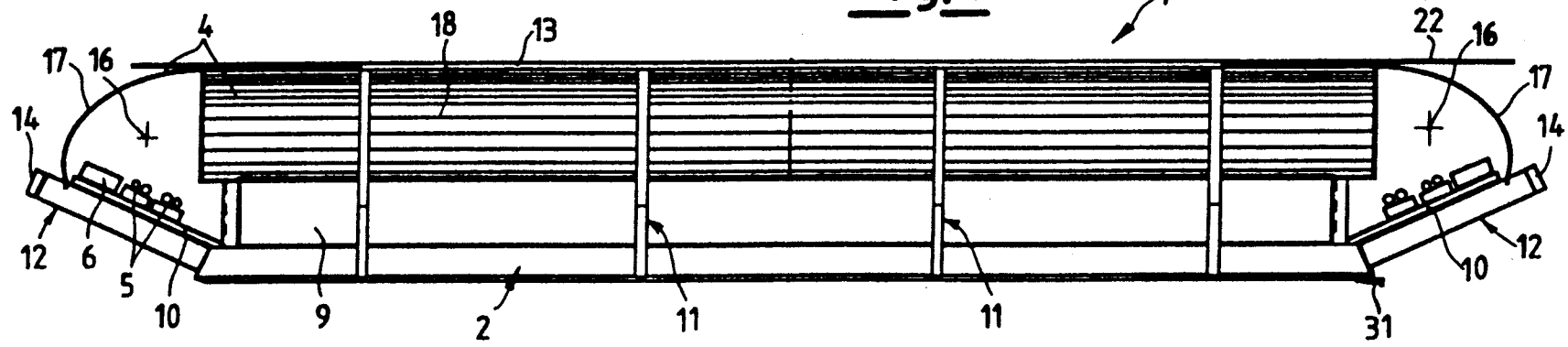
FIG. 4 is a side view on the major side.
Figure 3:
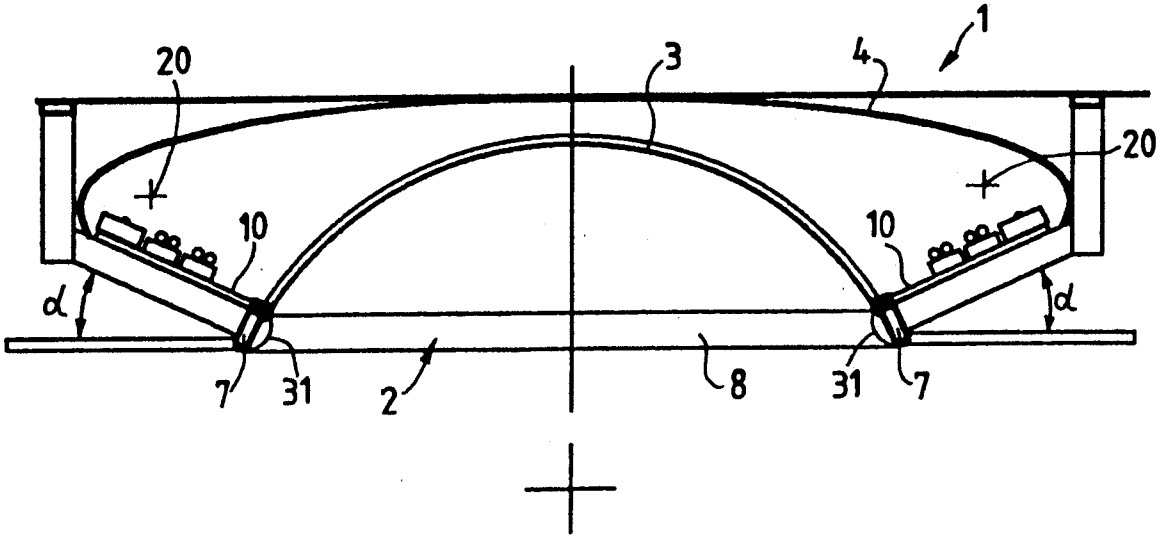
FIG. 3 is a section on the line III—III of FIG. 2 complete with the reflecting screen.
Figure 5:
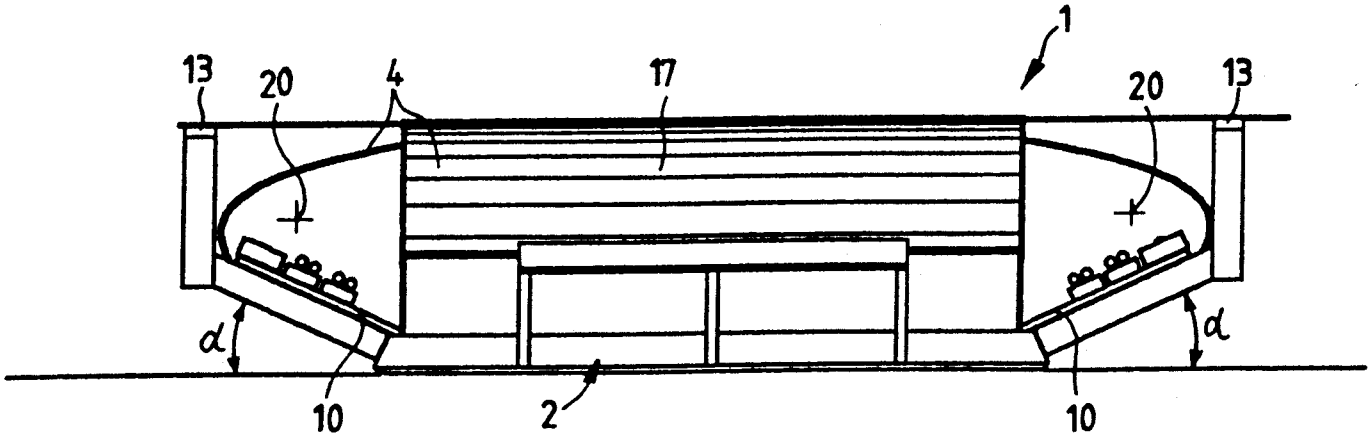
FIG. 5 is a side view on the minor side.

With reference to the aforesaid figures, the lighting appliance according to the invention, indicated overall by 1, substantially comprises a frame 2, a translucent screen 3, a reflecting screen 4 and light sources 5 and 6, which are of fluorescent and halogen type respectively. The frame 2, which has a structure similar to or simulating that of a traditional skylight, comprises pairs 7, 8 of parallel opposing tubular elements of greater and lesser length respectively, forming a closed structure about the translucent screen 3 which they support. A particular embodiment has a rectangular frame (2) and a translucent screen (3) which is concave with the concavity being in the same direction as the concave reflecting screen (4). The reflecting screen (4) may be of the semi-diffusing type which has a semi-opaque surface. The preferred semi-diffusing surface will have a white color.

A first truss 11 and a second truss 12 are fixed to the opposing tubular elements 7 and 8 to respectively support the planes 9 and 10 holding the light sources 5 and 6.

The planes 9 and 10 are supported in such a manner as to form an angle $\alpha$ of 25° to the plane in which the opposing tubular elements 7 and 8 lie. When the skylight is mounted, this plane corresponds to that of a traditional false ceiling 21.

The support trusses 11 and 12 respectively comprise tube pieces 13 and 14 positioned at different heights than but parallel to the tubular elements 7 and 8.

When the appliance 1 is installed, the tube pieces 13 abut against the overlying floor slab 22, to which they are fixed by traditional screws, not shown.

The tube pieces 14 can be used as handles for transporting and/or installing the appliance. The reflecting screen 4 comprises three portions, namely two lateral portions 17 and one central portion 18. The lateral portions 17 are supported by the trusses 12 and the central portion 18 is supported by the truss 11.

The lateral portions 17 are of parabolic cross-section with their foci lying on an axis 16 substantially parallel to the axis along which the light sources 5 and 6 are positioned, i.e. parallel to the tubular element 8.

Likewise the central portion 18 of the reflecting screen 4 has its foci lying on axes 20 parallel to those along which the relative light sources 5 and 6 are positioned, i.e. parallel to the tubular elements 7.

That surface of the reflecting screen 4 facing the light sources 5 and 6 is preferably of white semi-diffusing type, i.e. with a semi-opaque surface.

In the particular case illustrated the light sources are grouped into light source groups each comprising four fluorescent lamps 5 and at least one halogen lamp 6.

The light source groups positioned on the support panels 9 comprise a single halogen light source, whereas the light source groups positioned on the support panels 10 comprise two halogen light sources.

Figure 8:
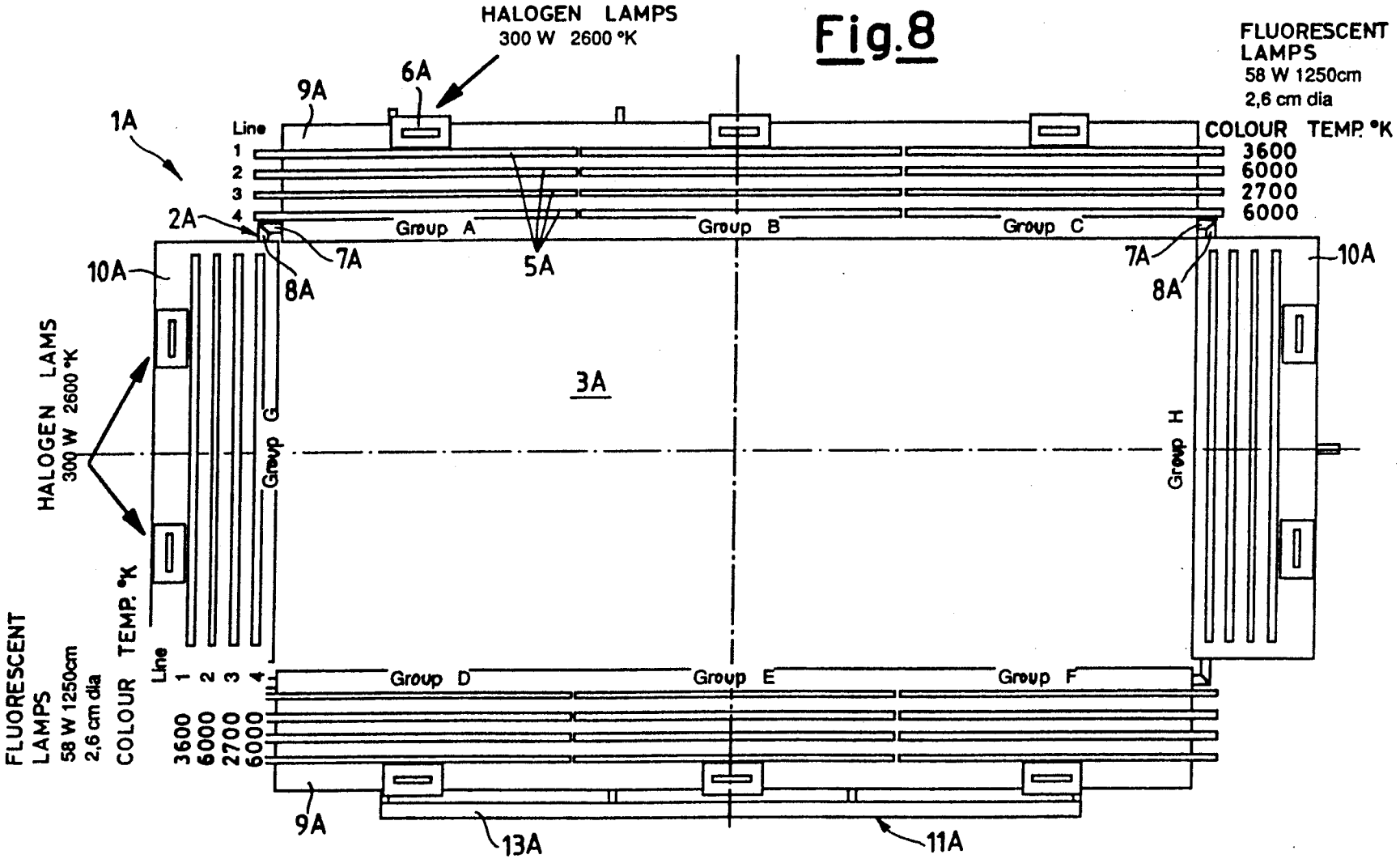
FIG. 8 is a view corresponding to that of FIG. 1 showing a further embodiment of the lighting appliance.

The appliance shown in FIG. 8 differs in that the light source groups positioned on the corresponding support panels 9A comprise two halogen light sources 6A.

The translucent screen 3 is constructed in several pieces, these in the case shown being of rectangular plan shape and arranged between the opposing tubular elements 7 and 8 such that the minor sides of said screen pieces are supported by the frame 2 parallel to its major sides 7, whereas the major sides of said screen pieces are supported by curved bars 23 of T cross-section.

Figure 6:
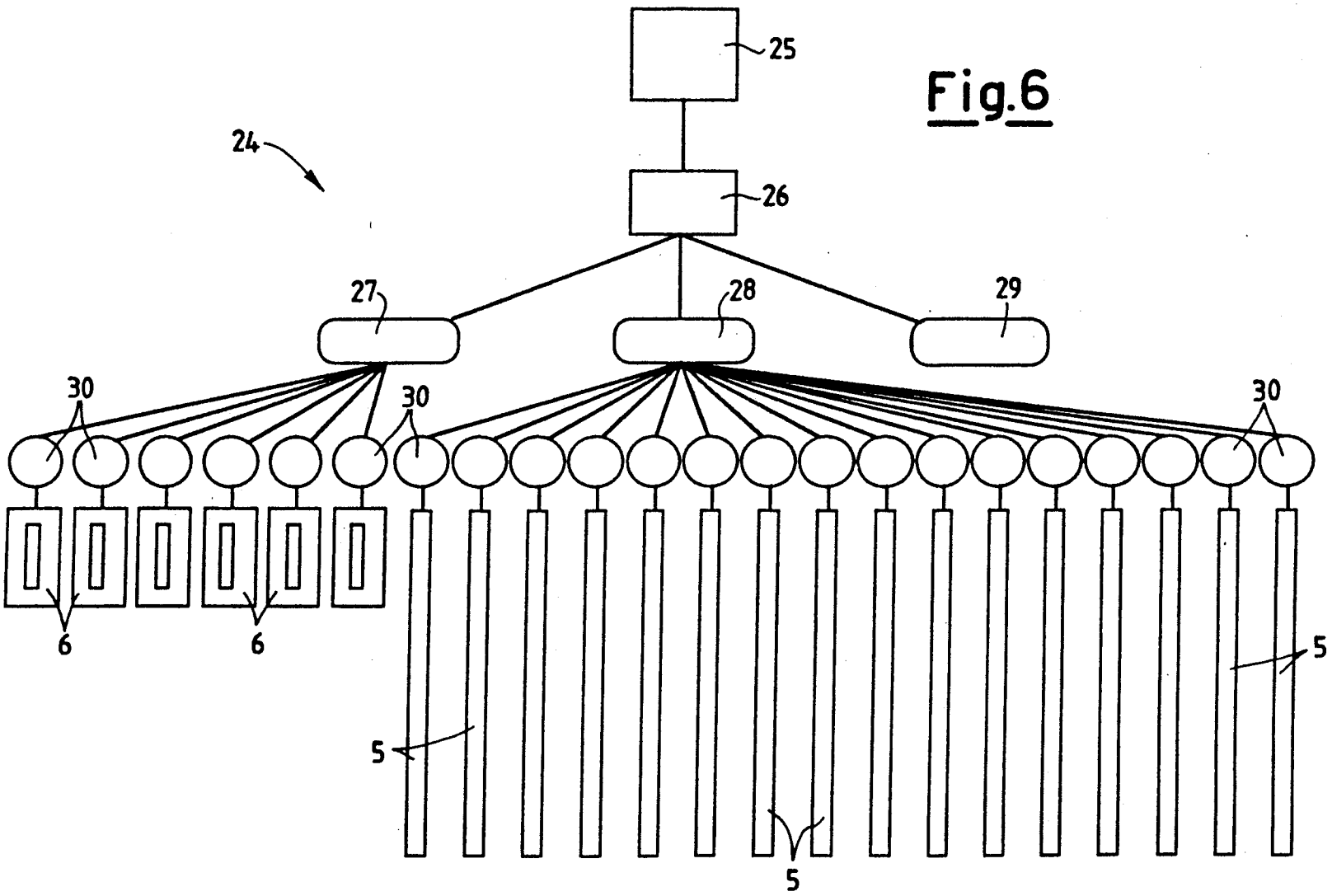
FIG. 6 is a schematic view of the central control unit for controlling the individual light sources of the appliance.
Figure 7:
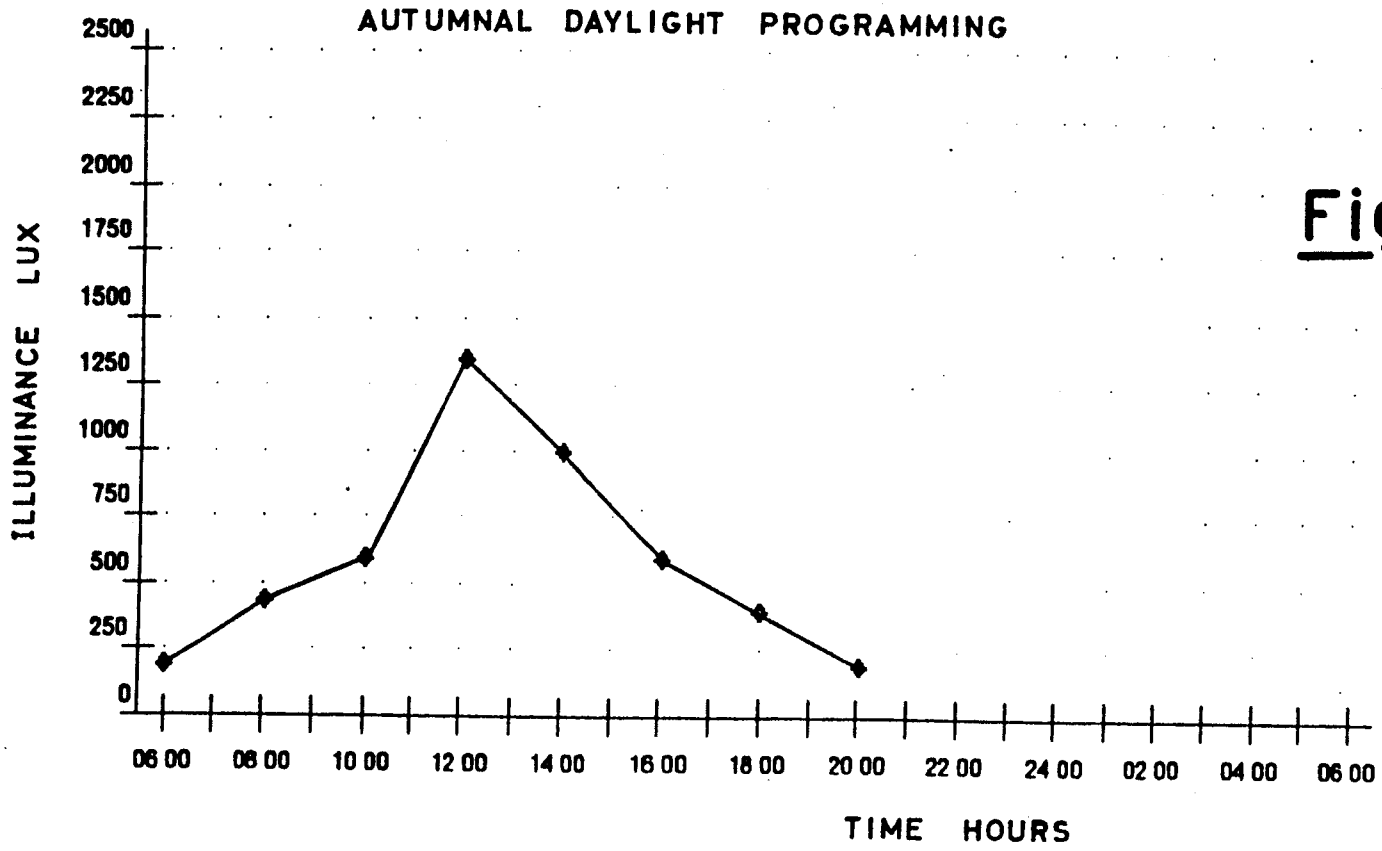
FIG. 7 is a graph illustrating the variation in the light emission of the appliance when programmed by the central unit to simulate autumnal daylight at a latitude of about 45°.

The translucent screen 3 is preferably of acrylic material. With particular reference to FIG. 6, the central control unit, indicated overall by 24, which controls the operation of each lamp comprises a computerized unit 25, a decoder 26, local control units 27–29 and dimmers 30 connected to the light sources 5 and 6. The computerized unit 25 operates on the basis of software which for example reproduces for a predetermined latitude the lighting conditions for an entire solar year of a determined climatic zone.

In this context the term "lighting conditions" means the intensity, colour temperature and exit direction of the light leaving the skylight. The decoder 26 acts as the interface between the computerized unit 25 and the local control units 27–29 so that the signals emitted by the unit 25 can be interpreted by the local control units 27–29. The local control unit 27 is arranged to control the dimmer 30 of each individual incandescent lamp such as the halogen lamps. The local control unit 28 is arranged to control the dimmer 30 of each individual fluorescent lamp 5.

The local control unit 23 is arranged to control the dimmer 30 of any individual capacitive discharge lamp.

Gaskets 31 are provided between the appliance 1 and the false ceiling 21 to make the skylight simulation offered by the appliance 1 perfectly functional.

We claim:

1. A lighting appliance (1) for environments without natural light, characterized by the following elements in combination:

a frame (2) rectangular in plan and totally surrounding a translucent screen (3);

a reflecting screen (4) side by side with said frame (2) and said translucent screen (3) said translucent screen being concave with the concavity being in the same direction as the concave reflecting screen (4);

light sources (5,6) positioned between said frame (2) and said reflecting screen (4) along the entire perimeter of said frame (2) so that emitted light beams from said light sources (5,6) are mixedly reflected by the reflecting screen (4) and conveyed from said lighting appliance (1) through the translucent screen (3), said light sources (5,6) being of different colour temperatures in terms of illumination and being electrically powerable separately in such a manner as to enable them to provide a luminous flux of variable intensity.

2. An appliance as claimed in claim 1, characterized in that said light sources (5, 6) are powered separately via a central control unit which varies their electrical quantities on the basis of the hour of the day.

3. An appliance as claimed in claim 1, characterized in that the translucent screen (3) is formed from a plurality of screen elements of rectangular plan, having major and minor sides, said minor sides being supported by the frame (2) parallel to said major sides, said major sides being supported by bars (23) of a T cross-section parallel to the minor sides of the frame (2).

4. An appliance as claimed in claim 3, characterized in that the translucent screen (3) is constructed of acrylic material.

5. An appliance as claimed in claim 1, characterized in that the light sources comprise fluorescent lamps (5) and halogen lamps (6).

6. An appliance as claimed in claim 5, characterized in that the fluorescent lamps (5) are arranged in rows with their major axis parallel to the sides of the frame (2) and having an inner row adjacent to said frame 2 and an outer row disposed as the last row which is the most distant from said inner row said fluorescent lamps having a colour temperature variable between 2700 and 6000° K., the halogen lamps (6) being arranged parallel thereto in the outer row and having a colour temperature of up to 2600° K.

7. An appliance as claimed in claim 1, characterized in that the reflecting screen (4) comprises for each side of the frame (2) a laminar element of parabolic cross-section having axes through its foci (16,20) substantially parallel to axes along which the light sources (5,6) lie, these latter being supported in planes (9,10) incident with a plane in which the frame (2) lies.

8. An appliance as claimed in claim 7, characterized in that an angle ($\alpha$) of 25° is formed between the planes (9,10) in which the light sources (5,6) are supported and said plane in which the frame lies.

9. An appliance as claimed in claim 7, characterized in that the reflecting screen is of the semis diffusing type.

10. An appliance as claimed in claim 9, characterized in that the semi-diffusing surface is white in colour.

11. An appliance as claimed in claim 1, characterized in that said rectangular frame (2) has a length and a width which are both multiplies of 60 cm.

12. An appliance as claimed in claim 1 characterized in that the frame (2) comprises gaskets (31) along tubular elements (7,8).

13. A lighting appliance (1) for environments without natural light, characterized by the following elements in combination:

a frame (2) totally surrounding a translucent screen (3);

a reflecting screen (4) side by side with said frame (2) and said translucent screen (3);

light sources (5,6) having different colour temperatures which are positioned between said frame (2) and said reflecting screen (4) along the perimeter of said frame (2) on support panels (9,10) so that emitted light beams from said light sources (5,6) are mixedly reflected by the reflecting screen (4) and conveyed from said lighting appliance (1) through the translucent screen (3), said light sources (5,6) being of different colour temperatures in terms of illumination and being electrically powerable separately in such a manner as to enable them to provide a luminous flux of variable intensity;

said translucent screen being concave in the direction of said reflecting screen and adapted to diffuse the light from said light sources; and a central control unit (24) which controls the operation of each light source, said control unit (24) comprising a computerized unit (25), a decoder (26) and local control units (27–29) to control the intensity, colour temperature and exit direction of the light leaving said lighting appliance.

14. An appliance as claimed in claim 13 wherein the reflecting screen is a semi-opaque white semi-diffusing reflecting screen.

15. An appliance as claimed in claim 13 wherein the light source comprises at least four flourescent lamps and at least one halogen lamp.

16. An appliance as defined in claim 13 wherein the light sources on support panels (9) comprise a single halogen light source and the light source on panels (10) comprise two halogen light sources.

17. An appliance as defined in claim 13 wherein the light source on support panels (9) comprise two halogen light sources.

* * * * *